US009102447B2

(12) United States Patent
Pils et al.

(10) Patent No.: US 9,102,447 B2
(45) Date of Patent: Aug. 11, 2015

(54) PUSH-PULL CLOSURE FOR A DRINK CONTAINER

(71) Applicant: MAPA GmbH, Zeven (DE)

(72) Inventors: Reiner Pils, Kalbe (DE); Uwe Wagenknecht, Tostedt (DE); Thorsten Hastedt, Heeslingen (DE)

(73) Assignee: MAPA GMBH, Zeven (DE)

( * ) Notice: Subject to any disclaimer, the term of this patent is extended or adjusted under 35 U.S.C. 154(b) by 0 days.

(21) Appl. No.: 13/770,673

(22) Filed: Feb. 19, 2013

(65) Prior Publication Data

US 2013/0214012 A1 Aug. 22, 2013

(30) Foreign Application Priority Data

Feb. 16, 2012 (DE) ..... 10 2012 002 935

(51) Int. Cl.
*B67D 3/00* (2006.01)
*B65D 47/24* (2006.01)

(52) U.S. Cl.
CPC ..... *B65D 47/243* (2013.01); *B65D 47/247* (2013.01)

(58) Field of Classification Search
CPC ..... B67D 3/00; B67D 3/043; B65D 47/242–47/244; B65D 47/247–47/248; B65D 47/061; B65D 47/286
USPC ..... 222/521–525, 509, 559
See application file for complete search history.

(56) References Cited

U.S. PATENT DOCUMENTS

| | | | | |
|---|---|---|---|---|
| 4,976,364 | A * | 12/1990 | Solomon | 215/229 |
| 5,429,282 | A * | 7/1995 | Stebick | 222/521 |
| 5,456,374 | A * | 10/1995 | Beck | 215/251 |
| 5,472,120 | A * | 12/1995 | Stebick et al. | 222/153.06 |
| 6,286,733 | B1 * | 9/2001 | Francois | 222/525 |
| 7,753,234 | B1 * | 7/2010 | Heiberger | 222/153.09 |

FOREIGN PATENT DOCUMENTS

| | | |
|---|---|---|
| DE | 102008023904 | 7/2010 |
| FR | 2731680 | 9/1996 |

* cited by examiner

*Primary Examiner* — Frederick C Nicolas
(74) *Attorney, Agent, or Firm* — Stuart H. Mayer; Mayer & Williams PC

(57) ABSTRACT

The invention is directed to a push-pull closure for a drink container including a mouthpiece holder. The container includes a pin, which projects into the through-opening of the mouthpiece holder; several bars, parallel to the pin and arranged around the pin, which are connected to the mouthpiece holder and to the pin; a mouthpiece that is axially displaceable and sealing with respect to the mouthpiece on the outer circumference and accommodating the pin in the further through-opening; at least one circumferential seal element, which blocks and unblocks the passage of liquid through the further through-opening in an closing/opening position of the mouthpiece in the mouthpiece holder; and several ribs of a soft elastic material, axially extending on the circumference of the mouthpiece at the bottom, wherein the mouthpiece may be inserted into the mouthpiece holder, and the bars can engage free spaces and the ribs engage recesses between the bars.

20 Claims, 6 Drawing Sheets

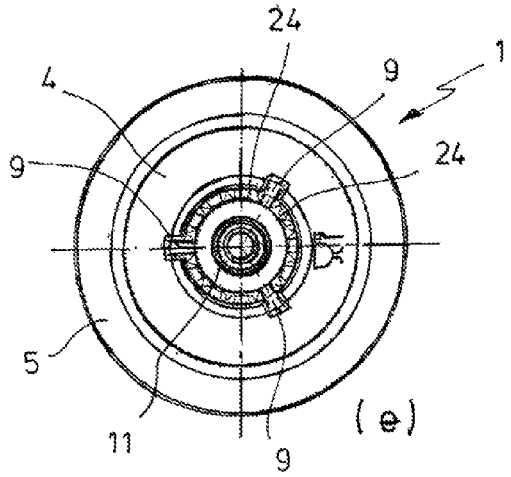
FIG. 1
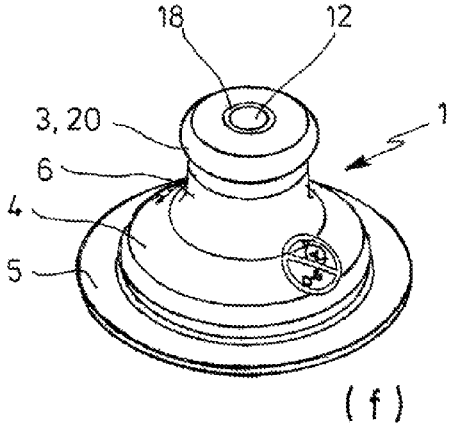
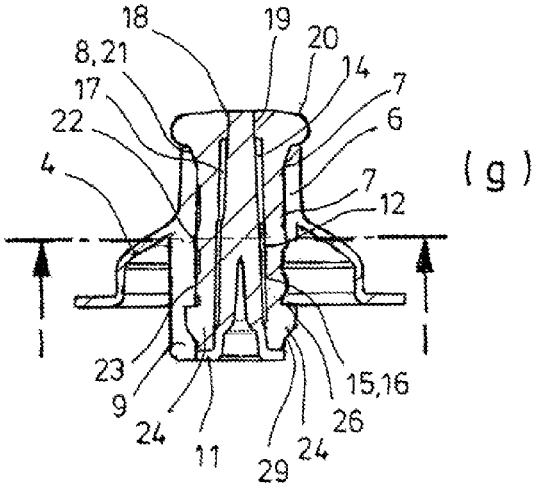
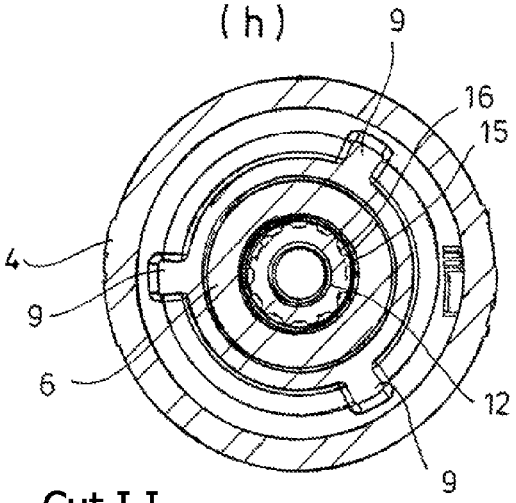
Cut I-I

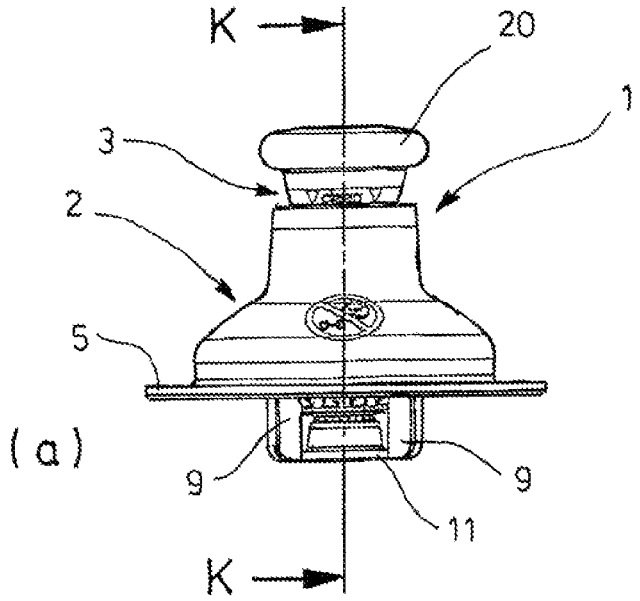
FIG.3
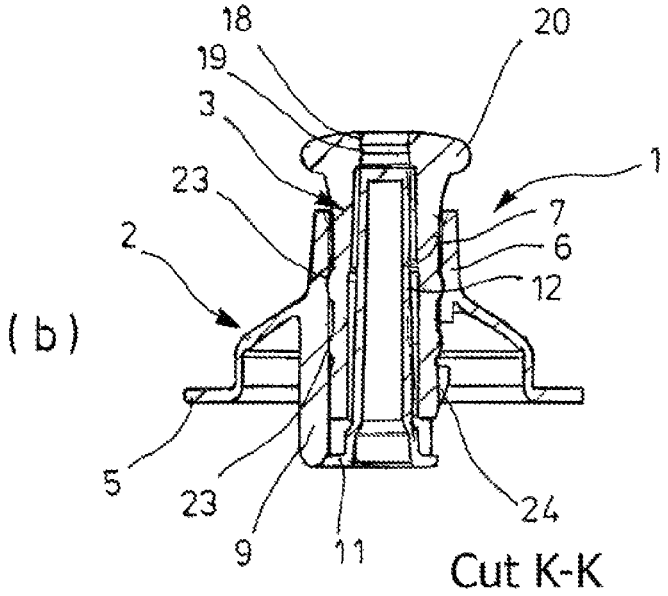

PUSH-PULL CLOSURE FOR A DRINK CONTAINER

CROSS-REFERENCE TO RELATED APPLICATIONS

This application claims priority under 35 U.S.C. §119 to German Patent Application No. 10 2012 002 935.7, filed on Feb. 16, 2012, in the German Patent and Trade Mark Office (DPMA), the disclosure of which is incorporated herein by reference in its entirety.

FIELD OF THE INVENTION

The present invention relates to a push-pull closure for a drink container, notably a drinking bottle or a drinking cup.

SUMMARY OF THE INVENTION

A push-pull closure has a mouthpiece which is accessible from the outside and arranged axially displaceably on a mouthpiece holder that may be connected to the drink container. The mouthpiece may be moved to and from between an opened and a closed position with the teeth or by hand. The closure is in most cases closed by pushing the mouthpiece deeper into the mouthpiece holder (push), and opened by pulling the mouthpiece farther out of the mouthpiece holder (pull). Such push-pull closures are distinguished in that the hands are usually not needed for opening and closing the closure. Therefore, they are widespread notably in the area of sport, for instance in drinking bottles for the bicycle sport. However, push-pull closures are also popular in many leisure activities and on drink containers for children, due to their easy handling.

The document FR 2 731 680 A1 describes a push-pull closure which has a closure cap for snapping it up onto a drinking bottle. A mouthpiece is movably arranged within a collar and able to occupy a closing position, a maximally opened position and a medium opening position. Further, the closure has means for temporarily blocking the mouthpiece in a desired position with respect to the collar. The means are arranged at the outside on the mouthpiece and suitable to arrive in bearing against the inner wall of the closure cap. The means for blocking comprise cams projecting from the circumference of the mouthpiece, which arrive in bearing against a flat upper stopping surface on the bottom side of the closure cap in the maximally opened position. At their lower side, the cams have a bevel in order to facilitate the insertion of the mouthpiece into the collar. Dismounting the mouthpiece requires to pull it out under very high expenditure of force accompanied by strong deformation or destruction of the cams.

The document DE 10 2008 023 904 B4 describes a push-pull closure for a drink container with a mouthpiece holder designated as body element, which has a through-opening and a fastening device by which it may be sealingly and releasably connected to an opening of the drink container. The closure comprises a mouthpiece with a through-opening for a beverage which may be axially displaceably inserted into the through-opening of the mouthpiece holder and which comprises at least one locking portion, which can engage behind the through-opening. In addition, there is a locking element, which may be releasably attached to the inner face of the mouthpiece holder facing the drink container. The locking element is arranged such that it projects at least partially into the through-opening of the mouthpiece. A gap between locking element and mouthpiece is dimensioned such that the locking portion of the mouthpiece may not adopt a position in which it does not engage behind the through-opening when the mouthpiece is inserted into the through-opening and the locking element is attached to the inner face of the mouthpiece holder. The closure may be cleaned in a simple manner and prevents unintended complete pulling out of the mouthpiece. This is notably intended to prevent that the mouthpiece is pulled out and swallowed by a baby. Due to its composition from a mouthpiece holder, a mouthpiece and a locking element, its production as well as its assembly and disassembly into single parts is relatively sumptuous.

Starting from this, the present invention is based on the task to provide a push-pull closure which effectively prevents unintended complete pulling out of the mouthpiece, can be produced at little cost and can be mounted and dismounted more easily.

The push-pull closure of the present invention has

- a mouthpiece holder, which has a through-opening and means for holding, by way of which it can be sealingly and detachably fastened on the edge of an opening of the drink container,
- a pin, which projects into the through-opening of the mouthpiece holder, wherein a circumferential gap exists between the pin and the through-opening of the mouthpiece holder,
- several bars, parallel to the pin and arranged around the pin, which are connected to the mouthpiece holder at the top and to the pin at the bottom,
- a mouthpiece with a further through-opening for a beverage, which can be inserted into the circumferential gap so as to be axially displaceable and sealing with respect to the mouthpiece on the outer circumference and accommodating the pin in the further through-opening,
- at least one circumferential seal element between the pin and the further through-opening, which blocks the passage of liquid through the further through-opening in a closing position of the mouthpiece in the mouthpiece holder, and unblocks the passage of liquid through the further through-opening in an opening position of the mouthpiece in the mouthpiece holder, and
- several ribs of a soft elastic material, axially extending on the circumference of the mouthpiece at the bottom, between which there are axially extending free spaces, wherein the mouthpiece may be inserted into the mouthpiece holder, so that the bars engage into the free spaces and the ribs engage into recesses between the bars, stopping surfaces present at the top edge of the ribs bear against the bottom side of the mouthpiece in an upper position of the mouthpiece, and the bars bend over neighbouring ribs into the free spaces when the mouthpiece is rotated with respect to the mouthpiece holder, and the mouthpiece may be pulled out from the through-opening under reduced extraction force.

In the push-pull closure of the present invention, the mouthpiece is sealed at its outer circumference with respect to the through-opening in the mouthpiece holder. Further, the mouthpiece may be axially dislocated into a closing position, in which at least one circumferential seal element seals between the pin and the further through-opening, so that liquid cannot exit through the further through-opening, i.e. the push-pull closure does not permit any liquid to leave. Further, the mouthpiece may be axially dislocated in the mouthpiece holder into an opening position, in which the seal element unblocks the further through-opening and liquid can be taken out from a drink container through the push-pull closure. The closing position is preferably a lower position of the mouthpiece, and the opening position is an upper position of the mouthpiece in the mouthpiece holder. Further, the mouthpiece is secured in the mouthpiece holder by stopping surfaces, which are formed at the upper edge of the ribs. That is to say, these stopping surfaces bear against the bottom side of the mouthpiece holder in an upper position of the mouthpiece in the mouthpiece holder, and thus they prevent the ribs from passing through the through-opening. The stopping surfaces are preferably surfaces which are directed vertically to the centre axis of the through-opening or the mouthpiece, respectively. In any case, the stopping surfaces are configured such that a high extraction force must be exerted in order to pull the mouthpiece out of the mouthpiece holder. An extraction force of at least 65 Newton must be preferably exerted for this. With a sufficiently high extraction force, it is made sure that the mouthpiece cannot be pulled out and swallowed without intent, by babies in particular. However, the closure may be dismounted easily for purposes of cleaning. For this purpose, the bars engage into the free spaces between the ribs, and the ribs into the recesses between the bars. As a consequence, the bars push neighbouring ribs into neighbouring free spaces when the mouthpiece is rotated in the mouthpiece holder. Then, the ribs bear more closely against the mouthpiece, so that the mouthpiece can be pulled out through the through-opening with reduced extraction force. In this, it is advantageous if the mouthpiece is rotated on a helical path when it is being pulled out, so that the ribs are made to bear flatly against the mouthpiece by overlapped bending by means of the bars and pulling into the through-opening. Thus, the push-pull closure can be decomposed into its component parts by purposeful overlapped twisting and drawing apart of mouthpiece and mouthpiece holder. Unintended pulling out of the mouthpiece or pulling out by a baby is avoided through this. When the soft elastic ribs are pulled out of the through-opening of the mouthpiece holder, they raise in their undeformed starting position again.

According to one embodiment, the mouthpiece holder has a sleeve-shaped portion through which the through-opening extends. The sleeve-shaped portion forms advantageously a guide for the mouthpiece and an area for sealingly holding the mouthpiece in the mouthpiece holder.

The through-opening is preferably arranged centrally in the mouthpiece holder. But it is also possible to arrange the through-opening eccentrically in the mouthpiece holder.

According to a further embodiment, the pin has an enlarged lower pin portion with increased diameter at its bottom, and/or the mouthpiece has an upper opening portion of the further through-opening with reduced diameter at the top, and in the closing position, the mouthpiece bears sealingly against the lower pin portion with a lower opening portion of the further through-opening and/or the pin bears sealingly against the upper opening portion of the further through-opening with an upper pin portion. The further through-opening is effectively sealed through this. Seal elements between the lower pin portion and the lower portion of the through-opening are preferably used, as well as such ones between the upper portion of the through-opening and the upper pin portion.

According to a further embodiment, the pin has further axially extending ribs of a soft elastic material at the outside, between which there are further axially extending free spaces. The further ribs favour high extraction forces for pulling the mouthpiece axially out of the mouthpiece holder, and reduction of the forces for mounting and dismounting by overlapped screwing and pulling the mouthpiece out of the mouthpiece holder. The extraction forces are notably high then when the further ribs are arranged directly radially below the ribs when the mouthpiece is inserted, so that they support the ribs at the inside. In order to facilitate mounting, the ribs can be pushed up above the further free spaces between the further ribs, so that they are not supported at the inside and may radially deform themselves towards the inside. Further, the ribs can be bent over above the further free spaces more easily in the dismounting, because the mouthpiece is not supported from the inside there.

According to a further embodiment, the cross section of the pin gradually enlarges from top to bottom. The sealing of the mouthpiece in the mouthpiece holder is further improved through this.

According to a further embodiment, the pin projects upward from a disc and the bars are connected to the circumference of the disc. The disc is preferably a circular annular disc. This structure is notably favourable for a production of the mouthpiece holder by injection moulding.

According to a further embodiment, the mouthpiece has a bead on the upper end at the outside, and/or at least one circumferential sealing shoulder on the outer circumference between the upper and the lower end, which bears against the through-opening when the mouthpiece is being inserted into the through-opening. The bead facilitates to open the closure with the teeth, and the sealing shoulder effects a good sealing of the mouthpiece in the through-opening.

Below the bead, the mouthpiece is preferably provided with a further circumferential sealing shoulder, which seals at the upper edge of the through-opening in the closing position of the mouthpiece in the mouthpiece holder. Additional sealing in the closing position is achieved through this.

The sealing shoulders are preferably made of a soft elastic material.

According to a further embodiment, there are two circumferential sealing shoulders in an axial distance from each other at the outer circumference of the mouthpiece. The two sealing shoulders are preferably arranged on the circumference of the mouthpiece such that only one sealing shoulder bears sealingly against the through-opening in a cleaning position of the mouthpiece within the mouthpiece holder, and a cleaning medium can be introduced from both sides through a gap between mouthpiece and through-opening.

According to a further embodiment, the through-opening has an upper lead-in chamfer at the upper end, and/or the axial ribs have a height which decreases towards their lower end. The insertion of the mouthpiece into the mouthpiece holder is facilitated through this.

According to a further embodiment, the height of the axial ribs is at least as great as their width. This facilitates to bend the axial ribs purposefully over into the free spaces in order to pull the mouthpiece out of the through-opening of the mouthpiece holder.

According to a further embodiment, the number of the axially extending ribs is a whole-number multiple of the number of the bars. Through this it is achieved that the ribs can always be placed between the bars. Preferably, ribs are uniformly distributed over the circumference of the mouthpiece for this purpose, and the bars are uniformly distributed around the pin.

According to a further embodiment, the mouthpiece has 9 to 18, preferably 12 axially extending ribs and/or the mouthpiece holder has 3 to 6, preferably 3 bars.

According to a further embodiment, the axially extending ribs have bevels on the two outer long side edges, and/or the bars on the two inner long side edges. Auto-centring of the mouthpiece on the bars is achieved by the bevels in the mounting. In addition, bending the ribs over into the free spaces, and thus the intended release of the mouthpiece from the mouthpiece holder is facilitated through this.

According to a further embodiment, the distance of the bevels of the axially extending ribs decreases from the base of the axially extending ribs towards the lower end of the ribs. The gradual bending over of the ribs from the lower end up to the upper end of the ribs is facilitated through this.

According to a further embodiment, the axially extending ribs have a lower lead-in chamfer directed vertically to the centre axis of the through-opening at their lower end. The lead-in chamfer facilitates the mounting of the mouthpiece in the mouthpiece holder.

According to a further embodiment, the mouthpiece and/or the mouthpiece holder consist entirely of a soft elastic material. The mouthpiece and/or the mouthpiece holder are preferably made of silicone. Alternatively, the mouthpiece and/or the mouthpiece holder are made of a thermoplastic elastomer. The mouthpiece and/or the mouthpiece holder are preferably in one piece. Further preferably, the mouthpiece and/or the mouthpiece holder are made by injection moulding.

BRIEF DESCRIPTION OF THE DRAWINGS

The present invention will be explained in more detail by way of the attached drawings of an example of its realisation. In the drawings:

FIG. 3*a-b* show the same push-pull closure in a cleaning position in a view like FIG. 2 (FIG. 3*a*) and in a cut along the line K-K of FIG. 3*a* (FIG. 3*b*)

DETAILED DESCRIPTION OF THE INVENTION

In the present application, the designations "up" and "down" refer to an arrangement of the push-pull closure on the top on a drink container.

Figure 1:
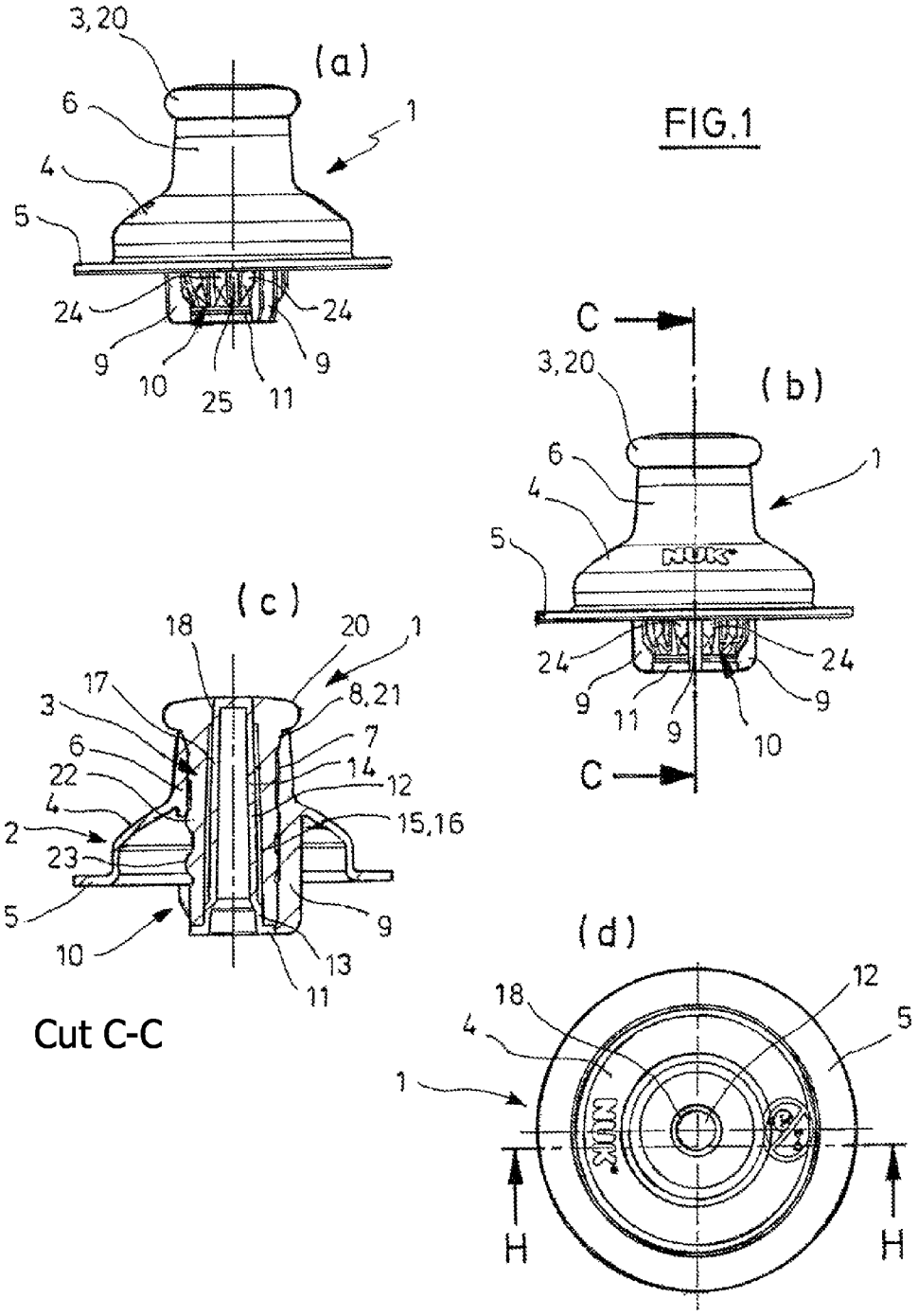
FIG. 1*a-h* show a push-pull closure in closing position in a side view (FIG. 1*a*), in a side view that is rotated about 45° with respect to FIG. 1*a* (FIG. 1*b*), in a cut along the line C-C of FIG. 1*b* (FIG. 1*c*), in a top view (FIG. 1*d*), in a view from the bottom (FIG. 1*e*), in a perspective view slant from the top and from the side (FIG. 1*f*), in a cut along the line H-H of FIG. 1*d* (FIG. 1*g*) and in an enlarged cut along the line I-I of FIG. 1*g* (FIG. 1*h*)
Figure 2:
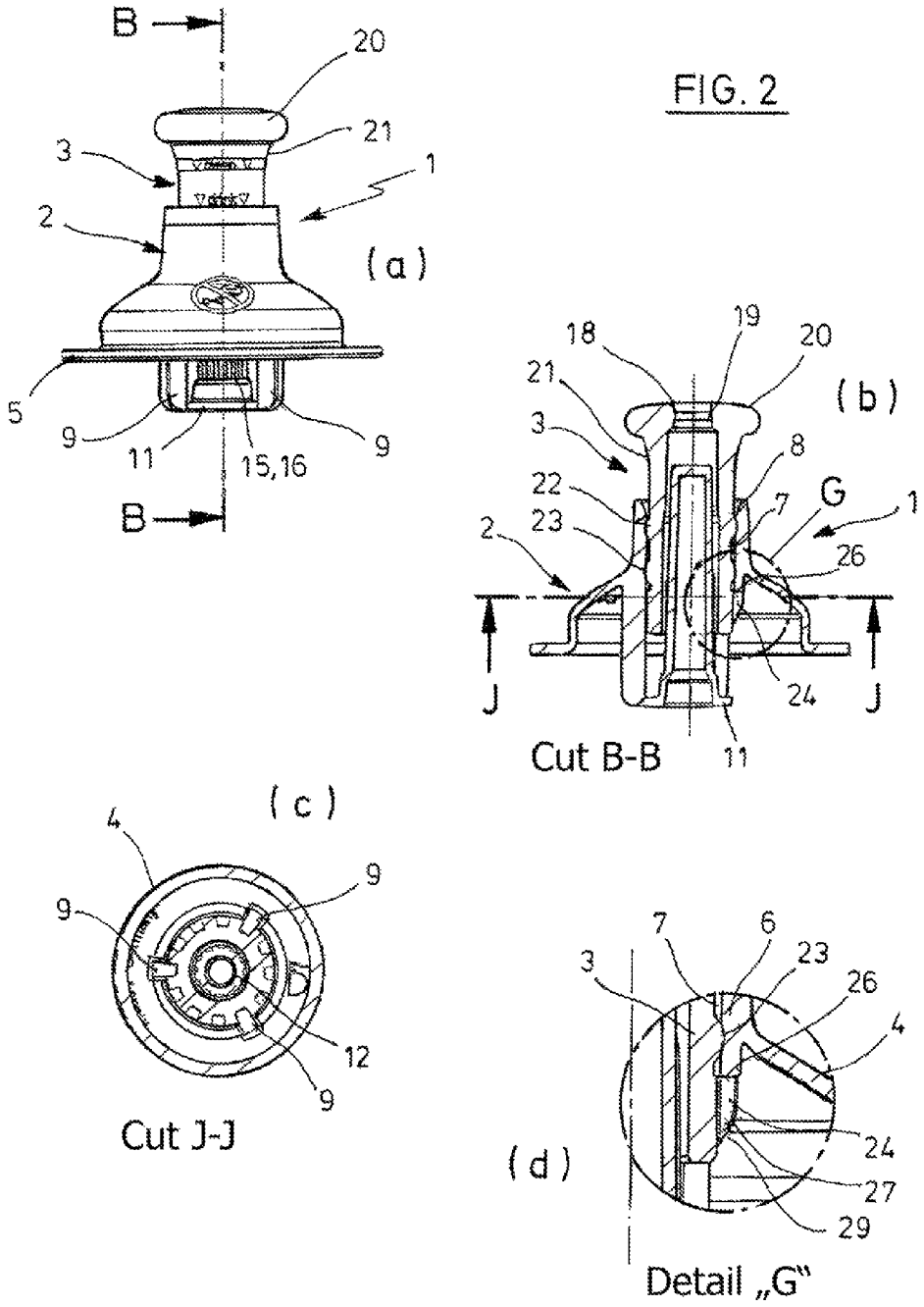
FIG. 2*a-f* show the same push-pull closure in opening position in a view opposite to the view of FIG. 1*b* (FIG. 2*a*), in a cut along the line B-B of FIG. 2*a* (FIG. 2*b*), in a cut along the line J-J of FIG. 2*b* (FIG. 2*c*), in an enlarged cut-out G of FIG. 2*b* (FIG. 2*d*), in a perspective view slant from the bottom and from the side (FIG. 2*e*) and in an enlarged cut-out E of FIG. 2*e* (FIG. 2*f*)
Figure 2:
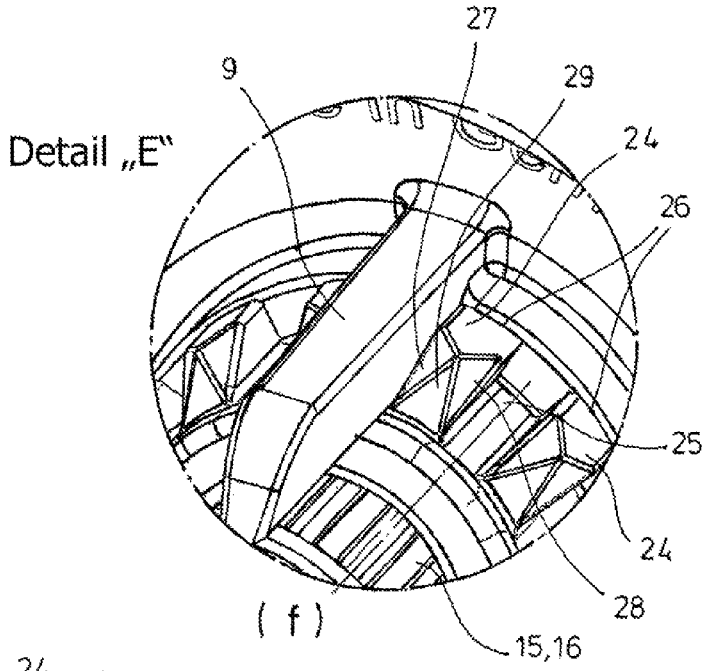
Figure 2:
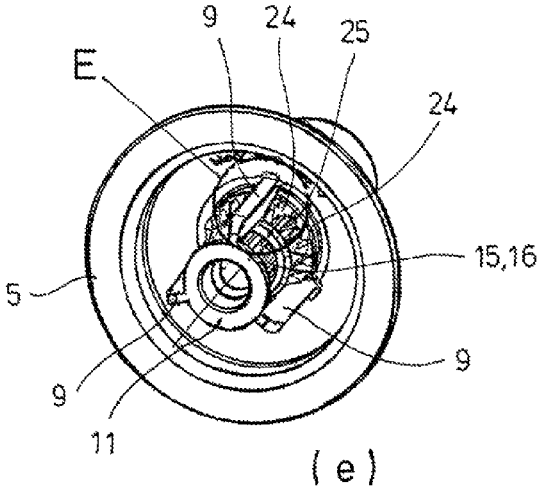

According to FIGS. 1 and 2, the push-pull closure 1 of the present invention comprises a mouthpiece holder 2 and a mouthpiece 3.

The mouthpiece holder 2 has a dome-shaped cover wall 4 and a circumferential annular flange 5 which projects outwardly from the outer edge of the cover wall 4. Further, the mouthpiece holder 2 has a vertical sleeve-shaped portion 6, which is arranged on the apex of the cover wall 4. The sleeve-shaped portion 6 projects far beyond the cover wall 4 at the top, and at the bottom only for a small part. A circular cylindrical through-opening 7 exists in the sleeve-shaped portion 6. The through-opening 7 has a lead-in chamfer 8 at its upper end by cone-like widening upward across a short portion there.

Three bars 9 protrude from the bottom side of the mouthpiece holder 2, which are distributed parallel to the through-opening 7 and uniformly around it. At the topside, the bars 9 are connected to that part of the sleeve-shaped portion 6 which protrudes from the bottom side of the cover wall 4, and also to a neighbouring area of the cover wall 4. They have a rectangular cross section. The bars 9 are arranged such that their inner edges fall in line with the through-opening 7. Recesses 10 exist between the bars 5.

The bars are connected to the circular annular disc 11 at their lower end. A pin 12 projects vertically upward from the inner edge of the disc 11. At the bottom, the pin 12 has a lower pin portion 13 with an enlarged diameter. The lower pin portion 13 has a conical shape that tapers somewhat towards the top. Further, the pin 12 has an upper pin portion 14, which has also a conical shape that tapers towards the top. The cone angles of the lower and upper pin portions 13, 14 are very small.

Bordering on the lower pin portion 13, the upper pin portion 14 has further axially extending ribs 15 on the circumference, between which there are further axially extending free spaces 16. In the example, there are twelve further ribs 15 and correspondingly twelve further, groove-like free spaces 16. The further ribs 15 have a trapezoidal or wave-shaped cross section. Their outer edges fall into a virtual cone surface which tapers towards the top.

The further ribs 15 end in a distance from the upper end of the pin 12, so that the pin 12 is smooth on its outer circumference at the upper end.

The mouthpiece 3 is essentially circular cylindrical. At the inside, it has a further circular cylindrical through-opening 17. The further through-opening 17 has a short upper opening portion 18 with reduced diameter. A circumferential bead-like inner sealing shoulder 10 exists in the upper opening portion. It is dimensioned such that the upper opening portion 18 may be sealingly pushed up onto the upper end of the upper pin portion 14. The further through-opening 17 has an inner diameter which is dimensioned such that it may be sealingly pushed up onto the lower pin portion 13 with its lower end.

At its upper end on the outside, the mouthpiece 3 has a bead 20, protruding outward and being rounded on the outer circumference.

Below the bead 20, the mouthpiece 3 has a short cone-shaped sealing shoulder 21 on its outer circumference.

About in the centre, the mouthpiece 3 has a circumferential, bead-like outer sealing shoulder 22 at the outside.

Moreover, about in the middle of the lower half at the outside, the mouthpiece 3 has a further circumferential, bead-like outer sealing shoulder 23.

Below this, the mouthpiece 3 has a plurality of ribs 24 on the outer circumference, extending axially and projecting radially outward. The ribs are uniformly distributed over the circumference. Between neighbouring ribs 24 there are always axially extending free spaces 25, which are groove-like in the example. There are twelve ribs 24 and twelve free spaces 25 in the example.

Each rib 24 has one planar stopping surface 26 at the top, which is directed vertically to the centre axis of the mouthpiece 3.

At the bottom, each rib 24 has a bevel 27, 28 on its two outer long side edges (compare FIG. 2*f*). The bevels 27, 28 are planar surfaces. The distance of the bevels 27, 28 from the base of the ribs 24 decreases towards the lower end of the ribs 24.

Moreover, each rib 24 has a further lead-in chamfer 29 at the bottom, which is formed by a planar surface here, which is aligned vertically to a plane which contains the centre axis of the mouthpiece 3. The bevels 27, 28 are arranged on both sides of the further lead-in chamfer 29.

The maximum height of each rib 24 exceeds its width. Further, the maximum height of each rib 24 corresponds to the width of the neighbouring free space 25.

The mouthpiece holder 2 and the mouthpiece 3 are each made in one piece from silicone, preferably by injection moulding.

In order to assemble the push-pull closure 1, the lower end of the mouthpiece 3 is put into the upper end of the sleeve-shaped portion 6. Due to the lead-in chamfers 8, 29, the mouthpiece 3 may be pushed easily into the through-opening 7. In doing so, the ribs 24 are elastically compressed radially, until they leave from the lower end of the sleeve-shaped portion 6 into the recesses 10 between the bars 9. Here, they adopt their original shape again.

The mouthpiece 3 may be rotated in the mouthpiece holder 2 such that the three bars 9 each engage into a free space 25 between a pair of neighbouring ribs 24.

The closure 1 may be sealingly fixed on the edge of the opening of a container. In this, the annular flange 5 rests on the upper edge of the container opening, and is engaged from the top by for instance a threaded ring. The threaded ring is screwed to an external thread of the container via a female thread. Thus, the annular flange 5 is sealingly pressed onto the upper edge of the container.

In the closing position, the mouthpiece 3 is maximally inserted into the mouthpiece holder 2. According to FIG. 1*e*, the sealing shoulder 22 bears sealingly against the through-opening 7. At its top, the cone-shaped sealing shoulder 21 bears sealingly against the lead-in chamfer 8.

Further, the inner sealing shoulder 19 bears sealingly against the upper end of the pin 12, and the lower end of the further through-opening 17 bears sealingly against the lower pin portion 13.

In this condition, liquid cannot leak out through the closure 1.

In order to open the closure 1, the mouthpiece 3 is pulled upward, until the ribs 24 bear against the lower edge of the sleeve-shaped portion 6 with their stopping surfaces 26. This is shown in FIG. 2. Liquid from a container onto which the closure 1 is screwed up can reach the lower end of the mouthpiece 3 through the recesses 10 between the three bars 9. The liquid can flow towards the outside on the pin 12, between the mouthpiece 3 and the pin 12 along the further free spaces 16, and leave through the upper opening portion 18 of the mouthpiece 3. Both sealing shoulders 22, 23 seal in the through-opening 7.

FIG. 3 shows the mouthpiece 3 in an intermediate position between the closing position and the opening position, in which it can be pulled out of the mouthpiece holder 2 only partially. This position is a cleaning position, in which liquid can enter the gap between mouthpiece holder 2 and mouthpiece 3 from the top as well as from the bottom, in order to clean this area. The passage of liquid is prevented only by the upper sealing shoulder 22.

The closure 1 may easily be purposefully dismembered for complete cleaning. In order to do this, the mouthpiece 3 is brought into the opening position of FIG. 2. Then, mouthpiece 3 and mouthpiece holder 2 are twisted against each other, so that the bars 9 bend neighbouring ribs 24 over into neighbouring free spaces 25. At the same time, mouthpiece 3 and mouthpiece holder 2 are pulled apart from each other. Through this, the ribs 24 are bent over in a helical movement and pulled into the through-opening 7. When all the ribs 24 have entered the through-opening 7, the mouthpiece 3 may be pulled out of the mouthpiece holder 2 easily. The separated parts can be subject to a thorough cleaning, and assembled again in the way described above.

Figure 4:
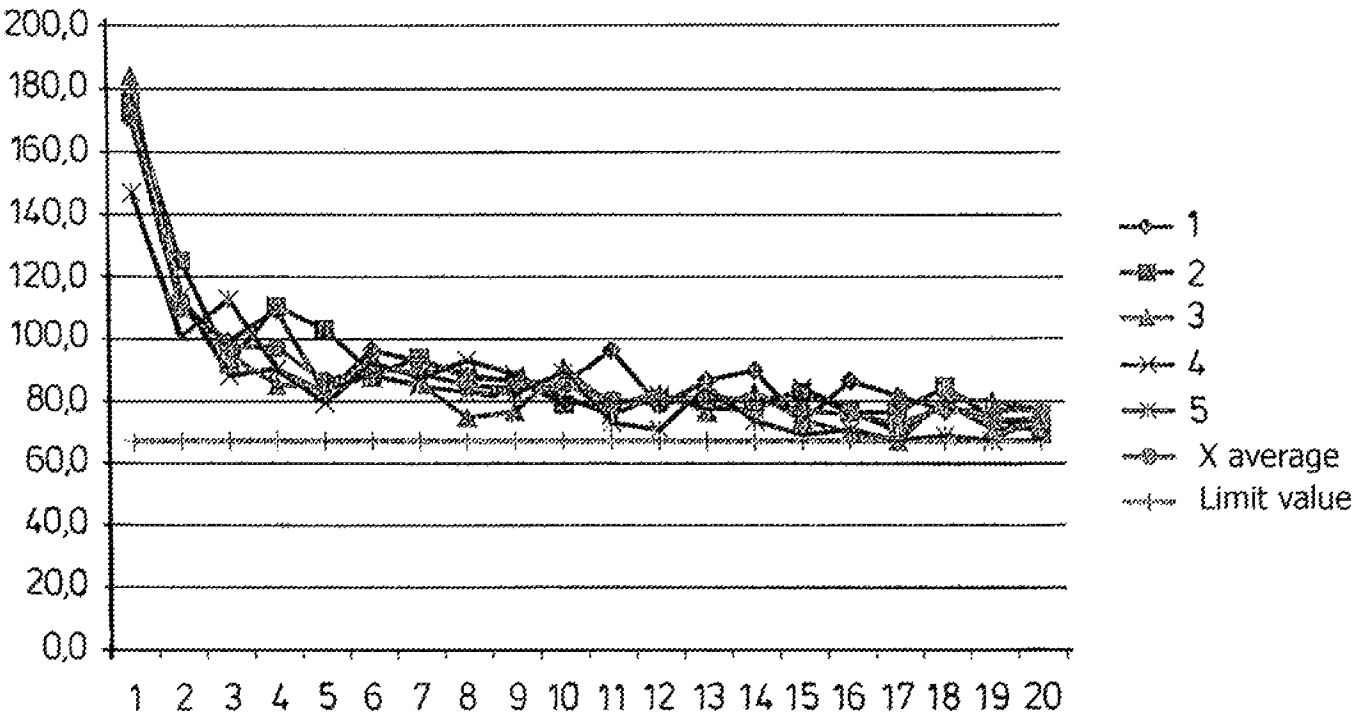
FIG. 4 provides a diagram with the extraction forces that must be exerted to pull the mouthpiece merely axially out of the mouthpiece holder on the Y-axis, and the number of extractions on the X-axis, in experiments with plural equal push-pull closures.

FIG. 4 shows that at five equal closures 1, the extraction force for pulling the mouthpiece 3 out of the mouthpiece holder 2 always exceeds a minimum value of 65 Newton. Even when the closures were disassembled and reassembled twenty times, this minimum value was maintained.

The invention claimed is:

1. A push-pull closure for a drink container, comprising:

a mouthpiece holder (2), which has a through-opening (7) and means for holding (5), by way of which the mouthpiece holder is sealingly and detachably fastenable on the edge of an opening of the drink container;

a pin (12), which projects into the through-opening (7) of the mouthpiece holder (2), wherein a circumferential gap exists between the pin (12) and the through-opening (7) of the mouthpiece holder;

several bars (9), parallel to the pin (12) and arranged around the pin (12), which are connected to the mouthpiece holder (2) at the top and to the pin (12) at the bottom;

a mouthpiece (3) with a further through-opening (16) for a beverage, which can be inserted into the circumferential gap so as to be axially displaceable and sealing with respect to the mouthpiece (7) on the outer circumference and accommodating the pin (12) in the further through-opening (17), at least one circumferential seal element (22, 23) between the pin (12) and the further through-opening (17), which blocks the passage of liquid through the further through-opening (17) in a closing position of the mouthpiece (3) in the mouthpiece holder (2), and unblocks the passage of liquid through the further through-opening (17) in an opening position of the mouthpiece (3) in the mouthpiece holder (2), and several ribs (24) of a soft elastic material, axially extending on the circumference of the mouthpiece (3) at the bottom, between the several ribs are axially extending free spaces (25), wherein the mouthpiece (3) is insertable into the mouthpiece holder (2), so that the bars (9) engage into the free spaces (25) and the ribs (24) engage into recesses (10) between the bars (9), stopping surfaces (26) present at the top edge of the ribs (23) bear against the bottom side of the mouthpiece (3) in an upper position of the mouthpiece (3), and the bars (9) bend over neighboring ribs (24) into the free spaces (25) when the mouthpiece (3) is rotated with respect to the mouthpiece holder (2), and the mouthpiece (3) is displaceable from the through-opening (7) under reduced extraction force.

2. The push-pull closure according to claim 1, wherein the mouthpiece holder (3) has a sleeve-shaped portion (6) through which the through-opening (7) extends.

3. The push-pull closure according to claim 1, wherein the pin (12) has an enlarged lower pin portion (13) with increased diameter at a bottom of the pin, and/or the mouthpiece (3) has an upper opening portion (18) of the further through-opening (17) with reduced diameter at the top, and in the closing position, the mouthpiece (3) bears sealingly against the lower pin portion (13) with a lower opening portion of the further through-opening (17) and/or the pin (12) bears sealingly against the upper opening portion (18) of the further through-opening (17) with an upper pin portion (14).

4. The push-pull closure according to claim 1, wherein the pin (12) has further axially extending ribs (15) of a soft elastic material at the outside, between the axially extending ribs are further axially extending free spaces (16).

5. The push-pull closure according to claim 1, wherein the cross section of the pin (12) gradually enlarges from top to bottom.

6. The push-pull closure according to claim 1, wherein the pin (12) projects upward from a disc (11) and wherein the bars (9) are connected to the circumference of the disc (11).

7. The push-pull closure according to claim 1, wherein the mouthpiece (3) has a bead (20) on the upper end at the outside, and/or at least one circumferential sealing shoulder (22, 23) on the outer circumference between the upper and the lower end, which bears against the through-opening (7) when the mouthpiece (3) is inserted into the through-opening (7).

8. The push-pull closure according to claim 1, wherein the through-opening (7) has an upper lead-in chamfer (8) at the upper end, and/or wherein the ribs (24) have a height which decreases towards a lower end of the ribs.

9. The push-pull closure according to claim 1, wherein the height of the ribs (24) is at least as great as a width of the ribs.

10. The push-pull closure according to claim 1, wherein the number of the ribs (24) is a whole-number multiple of the number of the bars (9).

11. The push-pull closure according to claim 1, which has 9 to 18 ribs (24) and/or 3 to 6 bars (9).

12. The push-pull closure according to claim 1, wherein the ribs (24) have bevels (27, 28) on the two outer long side edges, and/or the bars on the two inner long side edges.

13. The push-pull closure according to claim 12, wherein the distance of the bevels (27, 28) of the ribs (24) decreases from the base of the ribs (24) towards the lower end of the ribs (24).

14. The push-pull closure according to claim 12, wherein the ribs (24) have a further lead-in chamfer (29) directed vertically to the centre axis of the through-opening (7) at a lower end of the ribs.

15. The push-pull closure according to claim 1, wherein the mouthpiece (3) and/or the mouthpiece holder (2) consist of a soft elastic material, preferably of silicone or a thermoplastic elastomer.

16. The push-pull closure according to claim 2, wherein the pin (12) has an enlarged lower pin portion (13) with increased diameter at a bottom of the pin, and/or the mouthpiece (3) has an upper opening portion (18) of the further through-opening (17) with reduced diameter at the top, and in the closing position, the mouthpiece (3) bears sealingly against the lower pin portion (13) with a lower opening portion of the further through-opening (17) and/or the pin (12) bears sealingly against the upper opening portion (18) of the further through-opening (17) with an upper pin portion (14).

17. The push-pull closure according to claim 3, wherein the pin (12) has further axially extending ribs (15) of a soft elastic material at the outside, between the axially extending ribs are further axially extending free spaces (16).

18. The push-pull closure according to claim 4, wherein the cross section of the pin (12) gradually enlarges from top to bottom.

19. The push-pull closure according to claim 5, wherein the pin (12) projects upward from a disc (11) and wherein the bars (9) are connected to the circumference of the disc (11).

20. The push-pull closure according to claim 6, wherein the mouthpiece (3) has a bead (20) on the upper end at the outside, and/or at least one circumferential sealing shoulder (22, 23) on the outer circumference between the upper and the lower end, which bears against the through-opening (7) when the mouthpiece (3) is inserted into the through-opening (7).

* * * * *